US005939995A

United States Patent [19]

Phillips

[11] Patent Number: 5,939,995

[45] Date of Patent: Aug. 17, 1999

[54] ENTERTAINMENT APPARATUS

[76] Inventor: Dorothy J. Phillips, Rte. 5, Box 447B, Bakersfield, Calif. 93307

[21] Appl. No.: 08/808,941

[22] Filed: Feb. 19, 1997

Related U.S. Application Data

[63] Continuation of application No. 08/291,929, Aug. 18, 1994, abandoned.

[51] Int. Cl.[6] ..... G08B 5/00

[52] U.S. Cl. ..... 340/815.4; 340/321; 340/326; 340/384.1; 369/31; 446/227

[58] Field of Search ..... 340/815.4, 573, 340/326, 332, 321, 384.1; 307/141; 369/31; 446/227

[56] References Cited

U.S. PATENT DOCUMENTS

| | | | |
|---|---|---|---|
| 3,898,383 | 8/1975 | Herbits | 362/253 |
| 4,038,561 | 7/1977 | Lorenz | 307/141 |
| 4,052,622 | 10/1977 | Lorenz | 361/202 |
| 5,307,051 | 4/1994 | Sedlmayr | 340/540 |

OTHER PUBLICATIONS

"Arabian Nights", published by Grosset & Dunlap, NY, ©1963.

The Washington Post describing a "Mother Goose Lamp" having a built–in cassette player and light.

Magazine advertisement for a "Story Teller Lamp" Payless Drug Store, p. 11.

*Primary Examiner*—Brent A. Swarthout
*Attorney, Agent, or Firm*—Worrel & Worrel

[57] ABSTRACT

An apparatus having a housing resembling an identifiable object, an electrical appliance mounted within the housing and interoperative therewith to suggest a theme and a mechanism borne by the housing in operable connection with the appliance for selective operation of the apparatus.

2 Claims, 2 Drawing Sheets

ENTERTAINMENT APPARATUS

This is a continuation of application Ser. No. 08/291,929 filed on Aug. 18, 1994, and now abandoned.

BACKGROUND OF THE INVENTION

1. Field of the Invention

The present invention relates to an entertainment apparatus and more particularly to such an entertainment apparatus which is suggestive of a theme and which operates in a manner consistent with that theme to provide a soothing atmosphere conducive to relaxation and emotional recovery for use by children, and medical patients of all types, particularly those under treatment for a severe or terminal illnesses.

2. Description of the Prior Art

There are a wide assortment of devices conventionally available which permit the operator to play recorded music, video recordings such as movies and games, and the like for purposes of entertainment entirely within the control of the operator and dependent upon the operator's choice of audio or video recordings. Similarly, there are a variety of devices which have heretofore been known to project lights or light images in an entertaining fashion substantially or completely within the control of the operator. All such prior art devices permit the operator to chose selections from a wealth of recorded materials.

There has not, however, heretofore been a device operable to assist in the physical and emotional recovery or treatment of seriously ill or terminal patients. Such emotional support is frequently of significant importance in aiding in the recovery of the patient or in providing the support necessary to ease the concerns of a terminal patient. This problem is particularly acute in the case of children suffering from serious or terminal diseases where it is very difficult or impossible to provide emotional comfort to such patients in a manner supportive of their treatment. In the case of children, and particularly small children, these problems are particularly aggravated at night when nurses or other attendants cannot be present at all times to provide the needed comfort.

Therefore, it has long been known that it would be desirable to have an apparatus operable to provide emotional support to people during times of stress and particularly to children being treated for serious and terminal diseases during all hours of the day but having particular utility during nighttime hours when attending care is not available.

SUMMARY OF THE INVENTION

Therefore, it is an object of the present invention to provide an entertainment apparatus having particular utility in affording emotional support to patients conducive to promoting their physical recovery or treatment during convalescence.

Another object is to provide such an apparatus which is particularly well suited to creating an atmosphere by way of a preprogrammed audio message in combination with light transmission suggestive of a theme which is conducive to creating a soothing and relaxing atmosphere.

Another object is to provide such an apparatus which is particularly well suited to affording emotional support to seriously ill and terminal child patients during nighttime hours when nurses and other attendants are not consistently available to provide such support.

Another object is provide such an apparatus which incorporates preprogrammed audio and visual messages suggestive of a theme affording the emotional support required by convalescing patients.

Another object is to provide such an apparatus which operates during a first cycle of operation to afford a predetermined audio program in combination with light transmission to suggest a comforting theme and which during a second cycle of operation operates in the manner of a night light consistent with the theme to promote sleep while affording the reassurance of a presence near the patient.

Another object is to provide such an apparatus which possesses a simplicity of operation suitable for operation by children of nearly any age while conversely providing a complex program of supportive transmissions suggestive of a strong and comforting presence in the room.

Another object is to provide such an apparatus which is suggestive of a mythological lamp housing a mythological force capable of comforting the patient.

Another object is to provide such an apparatus which is of compact form conveniently available for moving to any location and operable without prior adjustment from a conventional electrical power outlet.

Another object is to provide such an apparatus combining both audio and visual components to create a visual and audio impression fully compatible with the exterior configuration of the apparatus.

Further objects and advantages are to provide improved elements and arrangements thereof in an apparatus for the purposes described which is dependable, economical, durable and fully effective in accomplishing its intended purposes.

These and other objects and advantages are achieved in the preferred embodiment of the present invention having a housing bearing an exterior configuration suggestive of a mythological lamp, mounting an internal audio player operable to play a preprogrammed audio program, a light source mounted in the housing selectively operable to transmit light through transparent portions of the housing and an electrical system selectively operable to operate the audio player and the light source in a predefined sequence to create audio and visual impressions consistent with a theme created by the exterior configuration of the housing to provide comfort to persons and particularly convalescing patients of young age.

DESCRIPTION OF THE PREFERRED EMBODIMENT

Figure 1:
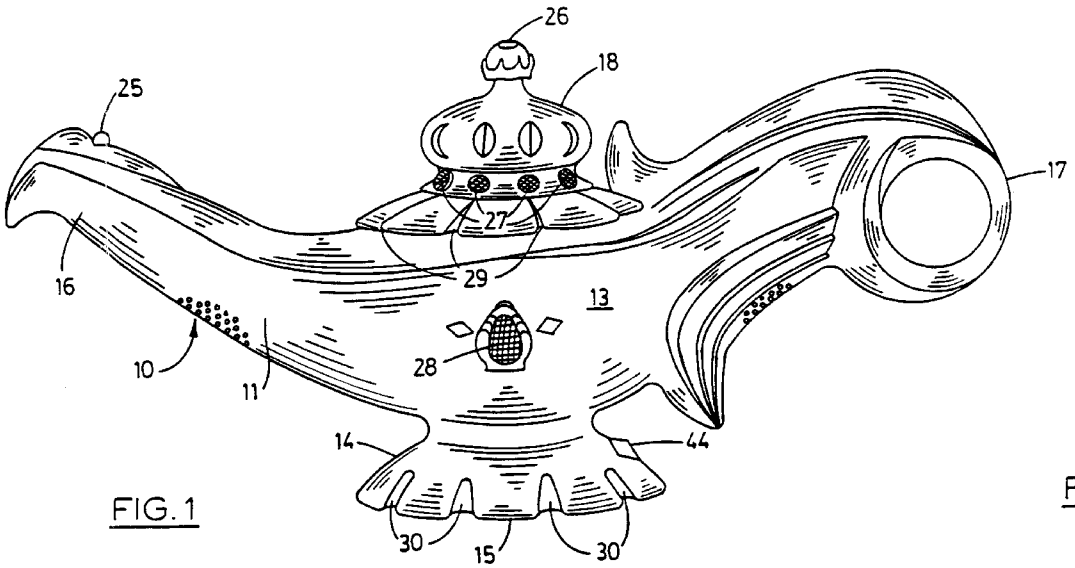
FIG. 1 is a side elevation of the entertainment apparatus of the present invention.

Referring more particularly to the drawings, the apparatus of the present invention is generally indicated by the numeral 10 in FIG. 1. As will subsequently become more clearly apparent, the apparatus of the present invention can be constructed in a wide variety of specific embodiments without departing from the invention. It is the objective in the preferred embodiment of the present invention to create a mood which is soothing while affording a sense of strength which is comforting to the patient. This same objective can be achieved with a wide variety of themes suited to this purpose. However, in the preferred embodiment shown herein, the theme is centered around the suggestion of a mythological lamp which can be operated to transmit a comforting audio message in combination with a sufficient light transmission to sooth the patient. This is achieved in the preferred embodiment by suggesting a lamp housing a power, such as a genie, which not only conveys the preprogrammed message but offers a warm and comforting presence in the patient's room.

Thus, the apparatus 10 has a housing 11 consisting preferably of a molded plastic or ceramic wall 12 having an exterior configuration 13 suggestive or resembling a mythological lamp. As such, the housing has a base 14 with a bottom surface 15. The housing 11 is adapted to rest on its bottom surface on a suitable surface of support such as that of a table or the like. The housing has a spout portion 16 and an opposite handle portion 17. The housing has a plume or lid portion 18.

Figure 2:
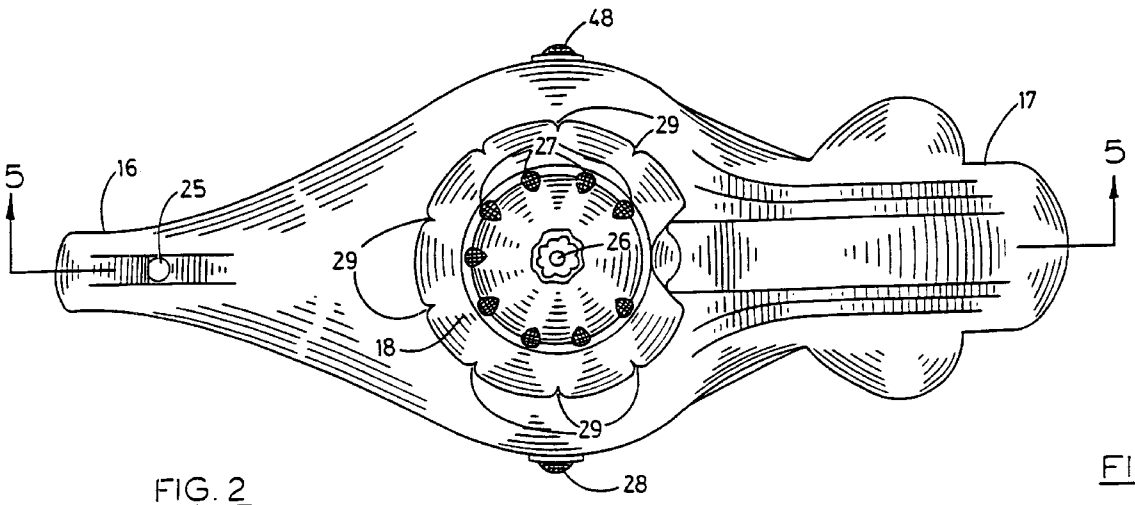
FIG. 2 is a top plan view of the entertainment apparatus of FIG. 1.

The spout portion 16 of the housing 11 has a transparent portion on the upper surface thereof constituting a spout light window 25. Similarly, the plume portion 18 of the housing has a transparent portion constituting an upper plume light window 26. A plurality of colored windows 27 are mounted in the plume portion extending in spaced relation thereabout, as can perhaps best be seen in FIG. 2. Similarly, a colored window 28 is provided in the housing substantially centrally thereof above the base 14. At the juncture of the plume portion 18 with the main portion of the housing, the wall 12 has a plurality of translucent portions 29 extending thereabout in spaced relation as can also best be seen in FIG. 2. Similarly, the base has a plurality of translucent portions 30 in the wall 12 extending thereabout. The light windows, colored windows and translucent portions are adapted to emit light from sources within the housing hereinafter to be described in such a manner as to suggest the warm and comforting presence previously referred to. In this regard, of course, the particular arrangement of the lights, coloring thereof, transparency or translucency thereof and the like may be varied as best to suit the mood to be created. However, the colored windows 27 and 28, in the preferred embodiment, have a red color and are cut in such a fashion so as to suggest a ruby or other jewel.

Figure 5:
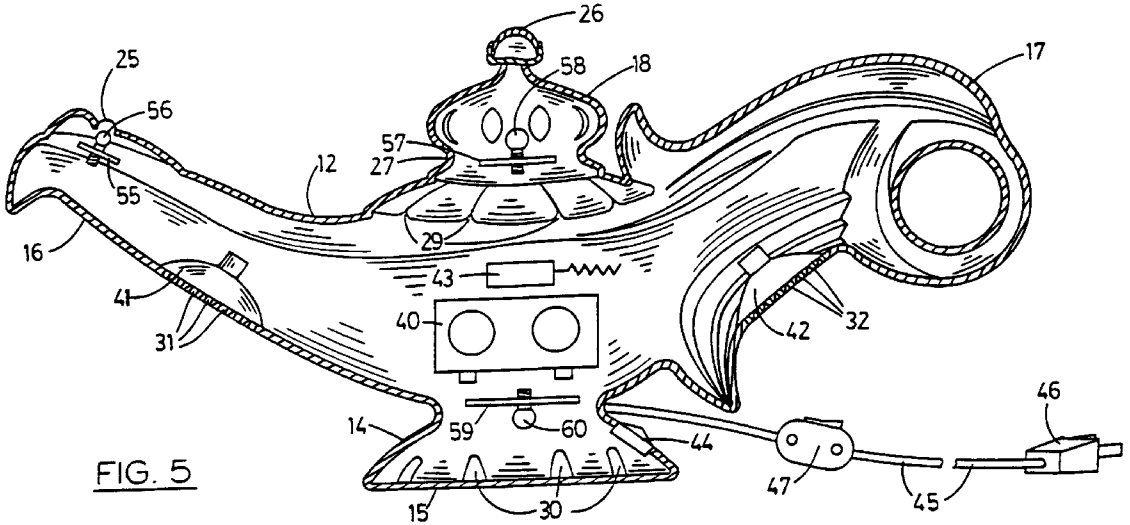
FIG. 5 is a longitudinal vertical section taken on line 5—5 in FIG. 2.

The spout portion 16 of the housing 11 has a plurality of speaker perforations 31 on the underside thereof as best shown in FIG. 5. Similarly, the handle portion 17 has a plurality of speaker perforations 32 on the under side thereof as best shown in FIG. 5.

Figure 3:
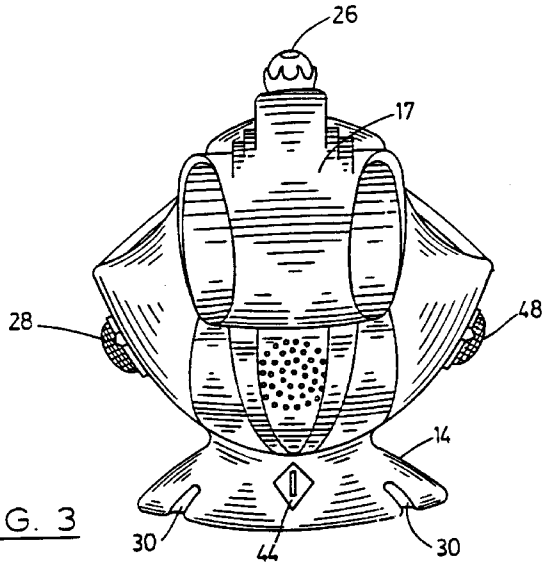
FIG. 3 is a rear plan view of the apparatus.
Figure 4:
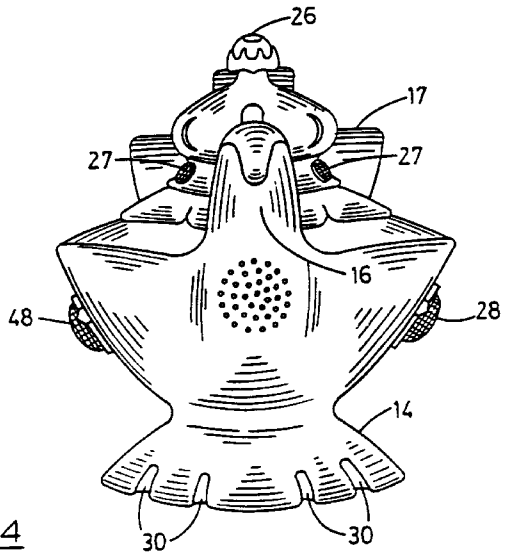
FIG. 4 is a front elevation of the apparatus.
Figure 6:
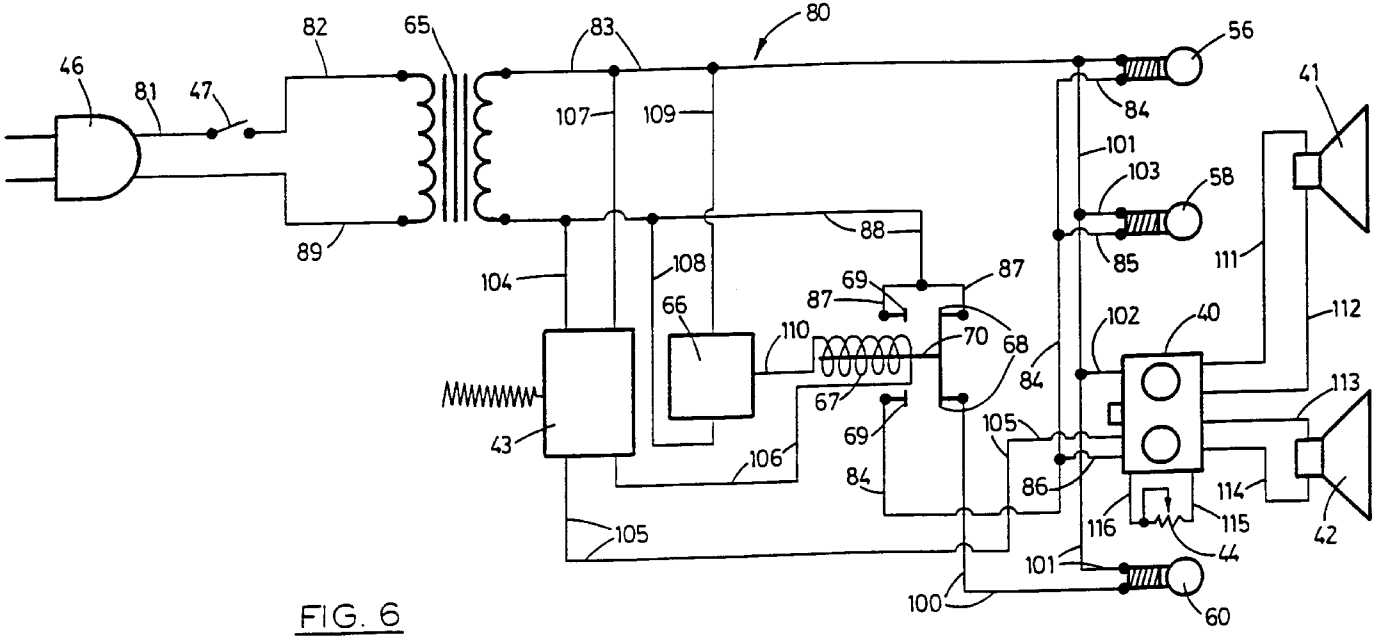
FIG. 6 is a schematic diagram of the electrical system of the apparatus of the present invention.

Referring more particularly to FIGS. 5 and 6, an audio tape player 40 is mounted in the interior of the housing 11. The audio tape player is preferably so constructed as to play a single recording suited to the theme and mood adopted for the objectives previously described. A speaker 41 is mounted within the housing 11 in communication with the speaker perforations 31. A speaker 42 is mounted within the housing and communication with the speaker perforations 32. A touch or pressure switch 43 is mounted within the housing on the back wall as viewed in FIG. 5. A volume switch 44 is mounted on the base 14 communicating with the exterior of the housing, as best shown in FIG. 5. A power cable 45 is extended from the interior of the housing outwardly of the base 14. The power cable has a conventional plug 46 adapted for insertion in a conventional electrical outlet. The power cable mounts a main power switch 47. As can best be seen in FIGS. 2, 3 and 4, in keeping with the theme of the embodiment of the invention, the pressure switch 43 mounted internally of the housing 11 communicates with a pressure switch window 48 on the right as viewed in FIG. 3 and on the left as viewed in FIG. 4. The switch window, as shown, appears to be a duplicate of the colored window 28 and may be either transparent or not as desired. It will be understood, however, that by exerting pressure on the pressure switch window 48, the pressure switch 43 is operated.

As shown in FIG. 5, a mount 55 is mounted in the spout portion 16 and, in turn, mounts a spout light bulb 56 in alignment with the light window 25. A mount 57 is mounted within the housing 11 and, in turn, mounts a plume light bulb 58. A mount 59 is mounted in the housing immediately above the base 14 thereof and, in turn, mounts a base or night light bulb 60.

Referring more particularly to FIG. 6, the apparatus 10 has a step down transformer 65 and a sequencing means, programmable timer/counter or controller 66. The controller may be of any suitable type and is shown herein schematically. The apparatus has a solenoid 67 having a pair of right switch contacts 68 and an opposite pair of left switch contacts 69, as shown in FIG. 6. The solenoid has a plunger 70 operable by operation of the solenoid to move between contacting the right switch contacts and contacting the left switch contacts for purposes hereinafter to be described.

The apparatus 10 has an electrical circuit 80, shown in FIG. 6. The electrical circuit has an electrical conductor 81 interconnecting the plug 46 and the main power switch 47 in the power cable 45. Electrical conductor 82 interconnects the main power switch and the transformer 65. Electrical conductor 83 interconnects the transformer and the light bulb 56. Electrical conductor 84 connects the light bulb 56 and the lower switch contact 69 on the left as viewed in FIG. 6 of the solenoid 67. Electrical conductor 85 interconnects the light bulb 58 and the electrical conductor 84. Electrical conductor 86 interconnects the audio tape player 40 and the electrical conductor 84. Electrical conductor 87 interconnects the upper left switch contact 69 and the upper right switch contact 68, as viewed in FIG. 6. Electrical conductor 88 interconnects electrical conductor 87 and the transformer 65. Electrical conductor 89 interconnects the transformer and the plug 46 through the power cable 45.

Electrical conductor 100 interconnects the lower most right switch contact 68 and the light bulb 60. Electrical conductor 101 interconnects the light bulb 60 and the electrical conductor 83. Electrical conductor 102 interconnects the audio tape player 40 and the electrical conductor 101. Electrical conductor 103 interconnects the light bulb 58 and the electrical conductor 101.

Electrical conductor 104 interconnects the electrical conductor 88 and the pressure switch 43. Electrical conductor 105 interconnects the pressure switch 43 and the audio tape player 40. Electrical conductor 106 interconnects the pressure switch 43 and the solenoid 67. Electrical conductor 107 interconnects the electrical conductor 83 and the pressure switch 43. Electrical conductor 108 interconnects electrical conductor 88 and the controller 66. Electrical conductor 109 interconnects the electrical conductor 83 and the controller 66. Electrical conductor 110 interconnects the controller 66 and the solenoid 67.

Electrical conductor 111 interconnects the audio tape player 40 and the speaker 41. Electrical conductor 112 interconnects the speaker 41 and the audio tape player 40. Electrical conductor 113 interconnects the audio tape player 40 and the speaker 42. Electrical conductor 114 interconnects the speaker 42 and the audio tape player 40. Electrical conductor 115 interconnects the audio tape player 40 and the volume control switch 44. Electrical conductor 116 interconnects the volume control switch 44 and the audio tape player 40.

OPERATION

The operation of the described embodiment of the present invention is believed to be readily apparent and is briefly summarized at this point.

The apparatus 10 is positioned at any suitable location for the purposes heretofore described. For purposes of illustrative convenience, it will be understood that the apparatus is positioned in rested relation on a table adjacent to the bed of a patient of child age. Thus, the bottom surface 15 of the base 14 is rested on the surface of the table adjacent to the bed. In order to place the apparatus in operative condition, the plug 46 is plugged into an available electrical outlet, not shown, and the main power switch 47 is closed to supply power to the transformer 65 and the controller 66. In this condition, the electrical circuit 80 is not activated beyond this supply of power since the pressure switch 43 is disposed in a normally open condition.

If the patient or the attendant wishes to activate the device, the pressure switch window 48 is contacted so as to operate the pressure switch 43. Depending upon the adjustment of the pressure switch and the connection of the pressure switch window, such activating contact can be by rubbing or simply exerting inward pressure. This action causes the pressure switch to close and thereby complete the circuit through the solenoid 67 and the controller 66.

Depending upon the type and program of the controller 66, such activation preferably causes the controller to supply electrical current to the solenoid which causes the plunger 70 thereof to be drawn to the left as viewed in FIG. 6 to contact the left switch contacts 69. This causes the spout light bulb 56, the plume light bulb 58 and the audio tape player 40 to be activated through electrical conductor 84. Thus, as can best be visualized in FIG. 5, the lights 56, 58 and the tape player are activated so that light emanates through the light window 25, the light window 26, the colored windows 27 and the translucent portions 29. Similarly, the audio tape player plays the recording adapted to provide a soothing and reassuring environment to the patient. The audio signal is transmitted through the speakers 41 and 42 from the apparatus. During this time, the patient or attendant can adjust the volume from the speakers by adjusting the volume switch 44 on the base 14 of the apparatus.

When the audio tape player 40 has run the recording through to the end and the controller 66 has allotted sufficient time for this to occur, the controller 66 operates the solenoid 67 to move the plunger to the right as viewed in FIG. 6 into contact with the switch contact 68. This causes the spout light bulb 56 and the plume light bulb 58 to be de-energized. This also activates the audio tape player 40 through electrical conductor 102 to rewind the tape thereof to a new start position. This also activates the night light 60 thereby causing light to emanate through the colored window 28, and the translucent portions 30 of the base 14 of the apparatus. The apparatus will continue in this cycle of operation until the pressure switch window 48 is again contacted to operate and open the pressure switch 43. This breaks the circuit and deactivates the night light 60 so that the device is completely inoperative until the pressure switch window 48 is again contacted to start the cycle over.

Therefore, the entertainment apparatus of the present invention is operable to provide emotional support to people during times of stress and particularly to children being treated for serious and terminal diseases during all hours of the day but having particular utility during nighttime hours when attending care is not available.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An entertainment apparatus operable to create a soothing atmosphere, the apparatus comprising a housing having a configuration suggestive of the theme of a mythological lamp including a base upon which the housing is adapted to rest in upright relation on a surface of support, a spout portion, a handle portion substantially opposite said spout portion and a lid portion substantially midway between said spout portion and said handle portion, and having transparent portions, said transparent portions comprising colored windows having the appearance of jewels, at least one of the transparent portions being mounted on the lid portion and at least one of the transparent portions being mounted on the housing at a central portion of the housing approximately midway between the lid portion and the base; an audio player mounted within said housing operable to play a recording consistent with said theme; a light source mounted within said housing including an electric light; sequencing means mounted on the housing which is operable sequentially to operate the audio player and light source consistent with said theme to transmit light through said transparent portions during operation of the audio player in a manner contributing to said theme and, subsequent to operation of the audio player, to transmit light through said transparent portions to serve as a night light; at least one speaker mounted within said housing in audio communication with the exterior thereof; and an electrical system operably interconnecting said sequencing means, audio player, light source and speaker operable to operate the audio player, light source and speaker to create a soothing atmosphere including transmitting sound from the audio player to the exterior of the housing and wherein said electrical system includes a switch mounted on the housing in communication with the exterior thereof, said switch means being mounted inside said at least one of the transparent portions mounted at the central portion of the housing and operable by the application of rubbing pressure thereto, operable to control the volume of the sound produced by said audio player and said transparent portions, light source and audio player interoperate under the control of said sequencing means to suggest that a mythological force is housed within said housing.

2. The apparatus of claim 1 wherein said audio player is operable to play only a predetermined recording.

* * * * *